US010883242B2

(12) United States Patent
Desborough et al.

(10) Patent No.: US 10,883,242 B2
(45) Date of Patent: Jan. 5, 2021

(54) PILE HAMMER

(71) Applicant: Dawson Construction Plant Limited, Milton Keynes (GB)

(72) Inventors: Stephen Desborough, Milton Keynes (GB); David Andrew Brown, Milton Keynes (GB)

(73) Assignee: DAWSON CONSTRUCTION PLANT LIMITED, Milton Keynes (GB)

( * ) Notice: Subject to any disclaimer, the term of this patent is extended or adjusted under 35 U.S.C. 154(b) by 67 days.

(21) Appl. No.: 16/314,330

(22) PCT Filed: Jun. 29, 2017

(86) PCT No.: PCT/GB2017/051891
§ 371 (c)(1),
(2) Date: Dec. 28, 2018

(87) PCT Pub. No.: WO2018/002616
PCT Pub. Date: Jan. 4, 2018

(65) Prior Publication Data

US 2019/0226173 A1 Jul. 25, 2019

(30) Foreign Application Priority Data

Jun. 30, 2016 (GB) ..... 1611366.4

(51) Int. Cl.
*E02D 11/00* (2006.01)
*B63B 21/26* (2006.01)
(Continued)

(52) U.S. Cl.
CPC ..... *E02D 7/10* (2013.01); *E02D 7/02* (2013.01); *E02D 7/06* (2013.01); *E02D 7/08* (2013.01)

(58) Field of Classification Search
CPC .... E02D 7/10; E02D 7/08; E02D 7/06; E02D 7/02
(Continued)

(56) References Cited

U.S. PATENT DOCUMENTS 1,463,785 A * 8/1923 Annison ..... E02D 7/10 91/278
1,629,622 A * 5/1927 Hiley ..... E02D 5/385 405/240
(Continued)

FOREIGN PATENT DOCUMENTS

| | | |
|---|---|---|
| GB | 2076718 | 12/1981 |
| GB | 2551774 | 1/2018 |
| WO | 2018002616 | 1/2018 |

OTHER PUBLICATIONS

Koulo, G,; International Search Report; dated Aug. 7, 2017; 2 pages; European Patent Office.
(Continued)

*Primary Examiner* — Edwin J Toledo-Duran
(74) *Attorney, Agent, or Firm* — Stetina Brunda Garred and Brucker

(57) ABSTRACT

A double-acting hydraulic impact hammer includes a drop weight and an inner hydraulic piston. The drop weight is arranged to be driven in an upward and downward direction and the drop weight acts on a pile during its downward motion. The piston has a voided internal area defining a piston volume which is arranged to receive a piston rod and along which the piston extends and retracts axially. The piston volume is in sealed hydraulic communication with the hollow rod volume to form a first volume which changes size as the piston moves along the piston rod whereby the application of hydraulic pressure to the first volume biases the piston towards its extended position. The hammer includes a bore and a collar. The collar forms an outer piston
(Continued)

having a working surface which when exposed to hydraulic fluid has sufficient surface area to lift the piston and the drop weight.

9 Claims, 4 Drawing Sheets

(51) Int. Cl.
*E02D 7/10* (2006.01)
*E02D 7/02* (2006.01)
*E02D 7/06* (2006.01)
*E02D 7/08* (2006.01)

(58) Field of Classification Search
USPC ..... 405/228, 232; 173/81–212; 92/172–260
See application file for complete search history.

(56) References Cited

U.S. PATENT DOCUMENTS 2,027,080 A * 1/1936 Wilcox ..... E02D 7/12 173/125
2,068,045 A * 1/1937 Wohlmeyer ..... E02D 7/10 173/18
2,167,983 A * 8/1939 Kiecksee ..... E02D 7/125 173/125
2,346,894 A * 4/1944 Gonne ..... 91/224
2,396,627 A * 3/1946 Wohlmeyer ..... 123/46 SC
2,755,783 A * 7/1956 Kupka ..... E02D 7/12 123/46 R
2,787,123 A * 4/1957 Delvaux ..... E02D 7/10 60/370
2,934,049 A * 4/1960 Spurlin ..... E02D 7/125 173/127
2,961,048 A * 11/1960 Davis, Sr. ..... E21B 31/113 173/129
2,969,771 A * 1/1961 Caudill ..... B21J 7/24 91/274
3,146,835 A * 9/1964 Hornstein ..... E02D 7/18 173/48
3,151,687 A * 10/1964 Shuichiro ..... E21B 7/26 175/21
3,194,328 A * 7/1965 Fiore ..... E02D 7/28 175/92
3,244,241 A * 4/1966 Ferwerda ..... B25D 16/00 173/105
3,357,315 A * 12/1967 Adams ..... E02D 7/10 91/277
3,595,324 A * 7/1971 Guild ..... E02D 7/125 173/121
3,669,198 A * 6/1972 Elliott ..... E02D 7/10 173/127
3,679,005 A * 7/1972 Inaba ..... B21J 7/26 173/128
3,680,644 A * 8/1972 Doughty ..... E02D 7/00 173/212
3,833,072 A * 9/1974 Back ..... E21B 19/20 175/85
3,847,230 A * 11/1974 Blomquist ..... E02D 7/20 173/127
3,939,922 A * 2/1976 Swenson ..... E02D 7/10 173/125
4,043,405 A * 8/1977 Kuhn ..... E02D 7/10 173/127
4,075,858 A * 2/1978 Frederick ..... E02D 7/10 405/228
4,102,408 A * 7/1978 Ludvigson ..... E02D 13/10 173/2
4,367,800 A * 1/1983 Arentsen ..... E02D 7/10 173/127
4,473,123 A * 9/1984 Ranft ..... E02D 7/125 173/1
5,113,950 A * 5/1992 Krasnoff ..... B25D 9/14 173/13
5,727,639 A * 3/1998 Jeter ..... B25D 9/04 173/126
6,378,951 B1 * 4/2002 Bouyoucos ..... E01C 23/124 173/206
2010/0012336 A1 * 1/2010 Adamson ..... E02D 7/02 173/1
2013/0199813 A1 * 8/2013 Zimmerman ..... E02D 7/10 173/200
2014/0314495 A1 * 10/2014 Arentsen ..... E02D 7/10 405/232

OTHER PUBLICATIONS

Gooch, Michael; Examination Report; dated Oct. 25, 2018; 3 pages; South Wales.

* cited by examiner

PILE HAMMER

CROSS-REFERENCE TO RELATED APPLICATIONS

The present application claims priority to PCT International Patent Application No. PCT/GB2017/051891, filed Jun. 29, 2017 and Great Britain Patent Application No. 1611366.4 filed on Jun. 30, 2016, the disclosure of which are incorporated herein by reference.

STATEMENT RE: FEDERALLY SPONSORED RESEARCH/DEVELOPMENT

Not Applicable

BACKGROUND

This invention relates to a double acting, hydraulic impact hammer for pile driving.

Piles are driven into the ground or seabed typically using an impact or percussive hammer. A drop weight, for example in the range 1 to 200 tonnes in weight or in some embodiments 1 to 12 tonnes, is lifted and then dropped onto the pile. A typical lift height is of the order 1 metre. To increase speed and efficiency a double acting hammer not only drives the drop weight upwards against gravity, but also assists the downward acceleration which increases the drop weight speeds, and therefore blow rate frequency, available from a solely gravity operated hammer. Repetition rates of the raising and lowering cycle of the order of 30 to 250 blows per minute can be achieved. Typically the amount of raise can be freely altered by the operator which then varies the energy being imparted to the pile. A beneficial effect of lowering the raise is that typically the blow rate increases since the travel of the drop weight which is required, is reduced.

It will be appreciated that the force required to lift the drop weight against gravity is less than that required to suitably accelerate the drop weight in the downward phase. Accordingly, in a hydraulically actuated device, it is acceptable to have asymmetry in the design of the actuating cylinder so that in a downward phase a smaller surface area piston may be used so that force is traded for increased speed for a given hydraulic fluid flow rate. This is important at least in part because with the pressures and forces involved and the relatively quick switching rates of the order of 1 to 4 Hertz, it is desirable to simplify the hydraulic circuitry. Thus it is desirable to have generally the same flow rates and pressures for both lifting and dropping phases so that differential forces between the phases will need to be achieved with hydraulic cylinder design.

In the prior art, a convenient way of achieving the suitable differential forces uses a side mounted cylinder or pair of cylinders fixed alongside the drop weight and having a piston rod extending upwardly from a piston to a fixing point towards the upper side of the drop weight. This is shown by way of example in prior art FIG. 1. A significant advantage of this arrangement is that the piston rod occupies a proportion of the cylinder which is used during the downward stroke of the drop weight meaning that the volume is filled more quickly on the downstroke than the upstroke for a given flow rate, and that the working surface area of the piston for the downward stroke is reduced. This provides the desired speed versus force asymmetry between lifting and dropping phases. However, this arrangement suffers several disadvantages. Firstly since the driving piston is located off to the side of the drop weight there is a torque couple between the hydraulic actuator and the drop weight, which puts undesirable side loads on the hydraulic actuator and the drop weight. Furthermore, the location of one or more hydraulic actuators alongside the drop weight increases packaging size and finally, for subsea environments, it is necessary to seal the hydraulic actuators from water ingress which then requires precision engineered covers which are expensive to manufacture and vulnerable to damage.

BRIEF SUMMARY

In accordance with a first aspect of the invention there is a provided a double-acting hydraulic impact hammer for pile driving, comprising a drop weight and an inner hydraulic piston, the drop weight being mechanically coupled to the inner hydraulic piston and being arranged to be driven in use, in an upward and downward direction and the drop weight being arranged to act on a pile during its downward motion, the inner hydraulic piston having a voided internal area defining an inner hydraulic piston volume which is arranged to receive a hollow piston rod and along which the inner hydraulic piston is free to extend and retract axially, the inner hydraulic piston volume being in sealed hydraulic communication with the hollow rod volume to form a composite first hydraulic volume which changes size as the inner hydraulic piston moves along the piston rod whereby the application of hydraulic pressure to the first volume biases the inner hydraulic piston towards its fully extended position, the hammer further including an outer bore surrounding the inner hydraulic piston and a collar fixed around the outside of the inner hydraulic piston which fits sealingly in the space defined between the outer bore and the outside of the inner hydraulic piston, the collar forming an outer piston having a working surface which is generally downward facing and which when exposed to hydraulic fluid at the same pressure as the first volume, has sufficient surface area relative to the working surface area of the inner hydraulic piston, to provide a generally upward force on the inner hydraulic piston sufficient to overcome the said extension biasing force and provide sufficient excess force to lift the inner hydraulic piston and the drop weight.

Preferably, the inner hydraulic piston and the piston rod is aligned generally with the center of mass of the drop weight so that in operation, lateral loads on the piston are minimized.

Typically, the drop weight is generally circular in cross-section and the inner hydraulic piston and more typically, piston rod may be generally aligned coaxially with the drop weight so that in operation, lateral loads on the piston are minimized.

Conveniently, the fluid supply for the outer piston passes through a passage in the outer bore.

Preferably, the outer bore is dimensioned to fit inside the drop weight when the inner hydraulic piston is in its retracted position.

In a second aspect, the invention provides a double-acting hydraulic impact hammer for pile driving, comprising a drop weight and an inner hydraulic piston, the drop weight being mechanically coupled to the inner hydraulic piston and being arranged to be driven in use, in an upward and downward direction and the drop weight being arranged to act on a pile during its downward motion, the inner hydraulic piston having a voided internal area defining an inner piston volume which is arranged to receive a hollow piston rod and along which the inner hydraulic piston is free to extend and retract axially, the inner hydraulic piston volume being in sealed hydraulic communication with the hollow rod volume to form a composite first hydraulic volume which changes size as the inner hydraulic piston moves along the piston rod whereby the application of hydraulic pressure to the first volume biases the inner hydraulic piston towards its fully extended position, the hammer further including an outer bore surrounding the inner hydraulic piston, the outer bore being dimensioned to fit inside the drop weight when the inner hydraulic piston is in its retracted position, and a collar fixed around the outside of the inner hydraulic piston which fits sealingly in the space defined between the outer bore and the outside of the inner hydraulic piston, the collar forming an outer piston having a working surface which is generally downward facing and which when exposed to hydraulic fluid at the same pressure as the first volume, has sufficient surface area relative to the working surface area of the inner hydraulic piston, to provide a generally upward force on the inner hydraulic piston sufficient to overcome the said extension biasing force and provide sufficient excess force to lift the inner hydraulic piston and the drop weight, and wherein the fluid supply for the outer piston passes through a passage in the outer bore.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The description below is given by way of example, and not limitation. Given the above disclosure, one skilled in the art could devise variations that are within the scope and spirit of the invention disclosed herein Further, the various features of the embodiments disclosed herein can be used alone, or in varying combinations with each other and are not intended to be limited to the specific combination described herein. Thus, the scope of the claims is not to be limited by the illustrated embodiments.

Figure 1:
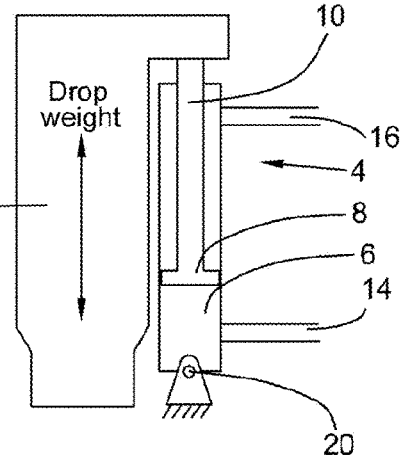
FIG. 1 is a schematic section through a prior art hydraulic impact hammer.

With reference to FIG. 1, a prior art impact hammer has a drop weight 2 which is actuated by a hydraulic actuator 4 having a cylinder 6 and a piston 8. The piston 8 is coupled to the drop weight 2 via a piston rod 10. The cylinder 6 is mounted to the outer case (not shown) via a pivot 12 to allow for small twisting moments on the cylinder as noted in the introduction to the present description.

As hydraulic fluid under pressure is introduced into the lower inlet 14, the piston 8 is caused to raise which also raises the drop weight 2. By relieving the pressure under the piston 8 and allowing oil to flow out of the inlet 14 into a reservoir or accumulator, the cylinder 8 is allowed to fall under gravity. In a double acting hammer this falling motion is assisted by introducing hydraulic fluid at pressure into an inlet 16 which is above the piston 8. It will be noted that the cross-sectional area of the cylinder above the piston 8 is smaller than that below the piston because the piston rod 10 takes up part of the volume. This means that the cylinder can be filled more quickly for a given flow rate of hydraulic fluid, during the downstroke.

Figure 2:
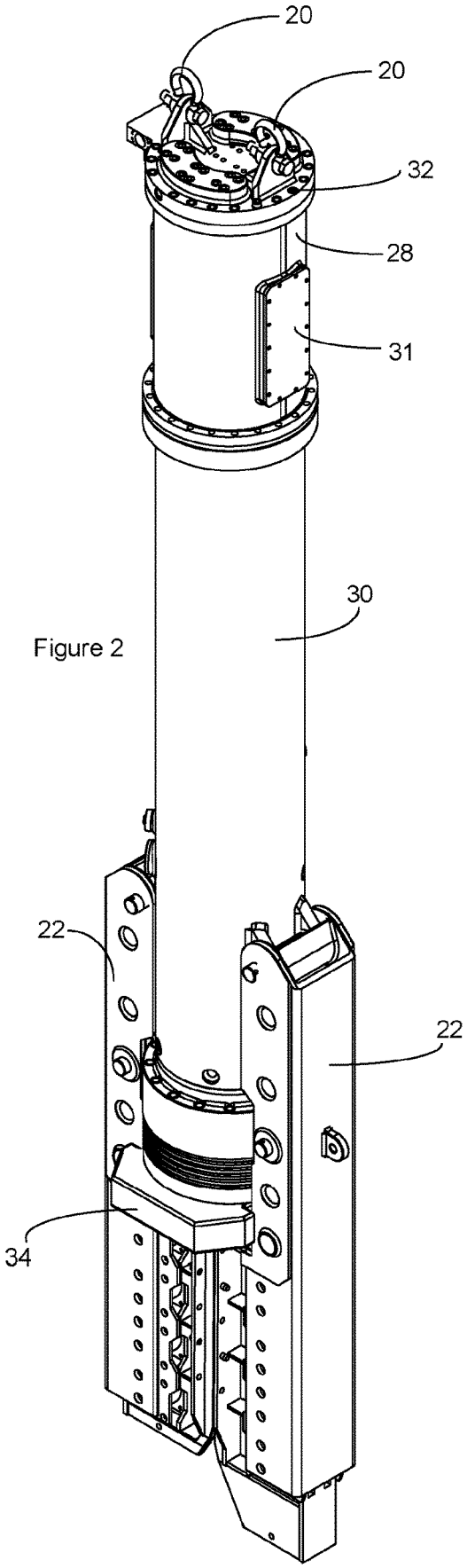
FIG. 2 is a perspective view of a complete hammer.
Figure 3:
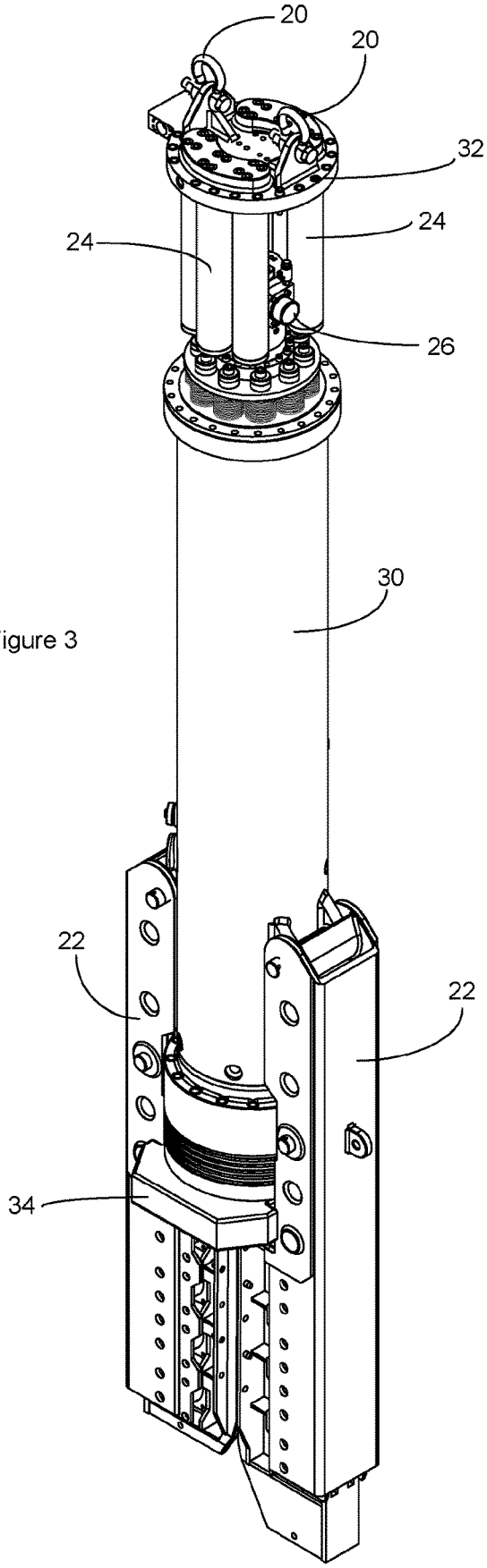
FIG. 3 is a perspective view of a complete hammer with upper covers removed.

With reference now to FIGS. 2 and 3, a complete hammer is shown in perspective views. The hammer may be crane suspended using mounting points 20 or rig mounted using leg guides 22. Hydraulic accumulators 24 and hydraulic control valves 26 are contained in an upper housing 28. A lower housing 30 contains a drop weight 36 and an integral piston which is described in more detail below. It will be noted in particular that this new arrangement does not have side mounted pistons and that consequently side loads on the piston and the drop weight are reduced or eliminated and packaging of the hammer is considerably improved.

Figure 5:
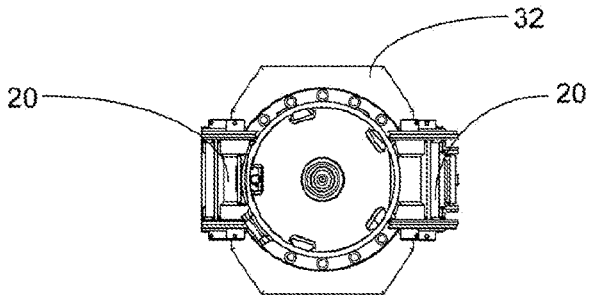
FIG. 5 is a section along line D-D of FIG. 4.
Figure 4:
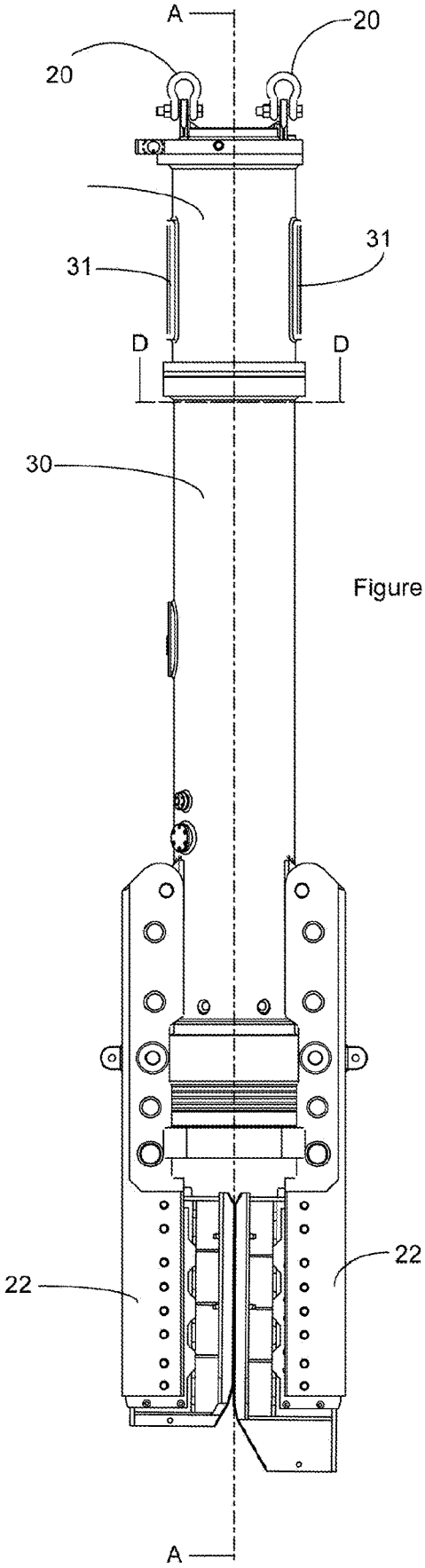
FIG. 4 is a side elevation of the complete hammer of FIGS. 2 and 3.
Figure 6:
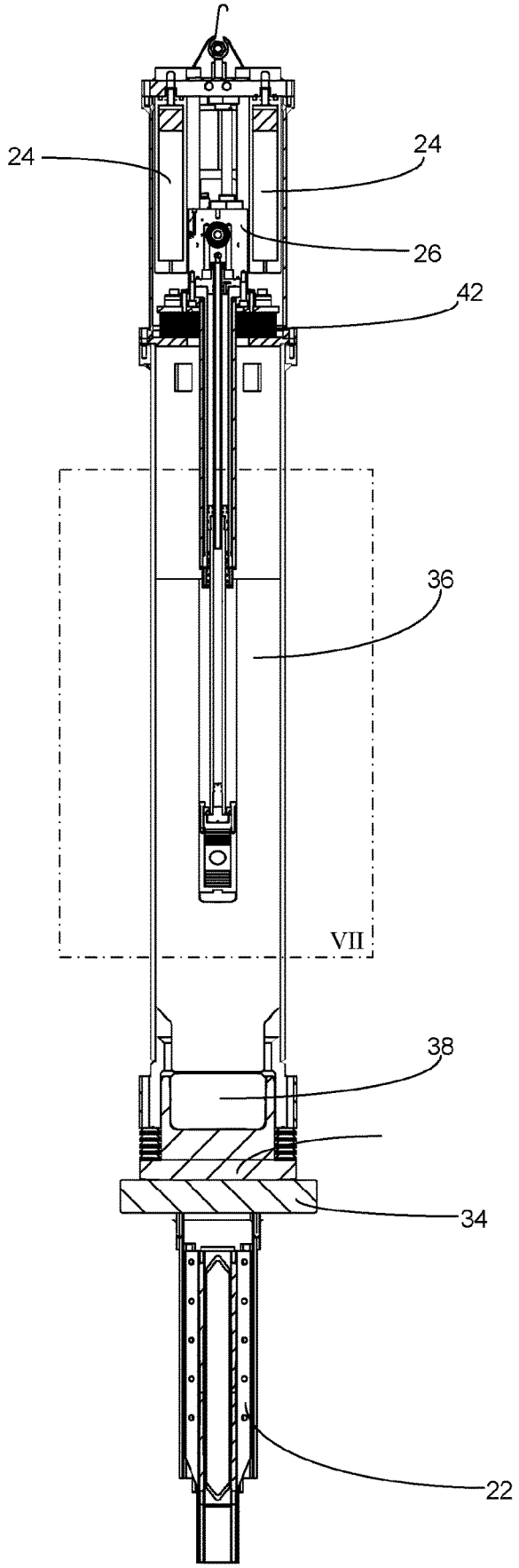
FIG. 6 is a section along line A-A of FIG. 4.

Access covers 31 in the upper housing 28, allow for maintenance of the valve block 26. The upper cover 28 also houses an electronics pack which has a proximity sensor capability so that the solenoid actuated valve block 26 can be switched at appropriate times during travel of the drop weight 36. A power-pack (not shown) supplies high pressure hydraulic fluid (e.g. at a pressure of between 200 and 300 bar) at a flow rate of several hundred liters a minute, sized to the weight of the drop weight of the hammer, to the valve block 26. The valve block is not discussed in detail but is a generally conventional design and allows the higher pressure hydraulic fluid to be switched between two circuits under the solenoid operation controlled by the electronics pack. With reference also to FIGS. 4 to 6, a top cover 32 holds the crane loops 20 and seals the top of the upper housing 28. With particular reference to FIG. 6, a spreader plate 34 forms the lower part of the lower housing 30 and helps transmit reaction forced to the leg guides 22.

A drop weight 36 is lifted and dropped by a hydraulic actuator which is described in more detail below. As the drop weight 36 falls, a hammer dolly 38 strikes an anvil 40 which then transmits energy through the leg guides 22 to the pile. Typical impact velocities are around 5 metres a second and with drop weights ranging from 1 to 200 tonnes in weight or in some embodiments 1 to 12 tonnes this provides impact energies in the range 1200 to 240000 kg·m. The hydraulic actuator is coupled to the drop weight 36 at a pivot 40 which includes dampers 42 to reduce shock loading passing back through the hydraulic actuator as the drop weight is rapidly decelerated when forces are transmitted to the pile which is being driven. These dampers are typically in the form of some type of spring such as a disc spring and the deceleration at impact on the pile may be of the order of 500 g. Further damping is provided by a spring pack 42 which mounts the top of hydraulic actuator to the housing. In this way the hydraulic actuator is partially isolated from the shock loads transmitted through the housing and the drop weight.

Figure 7:
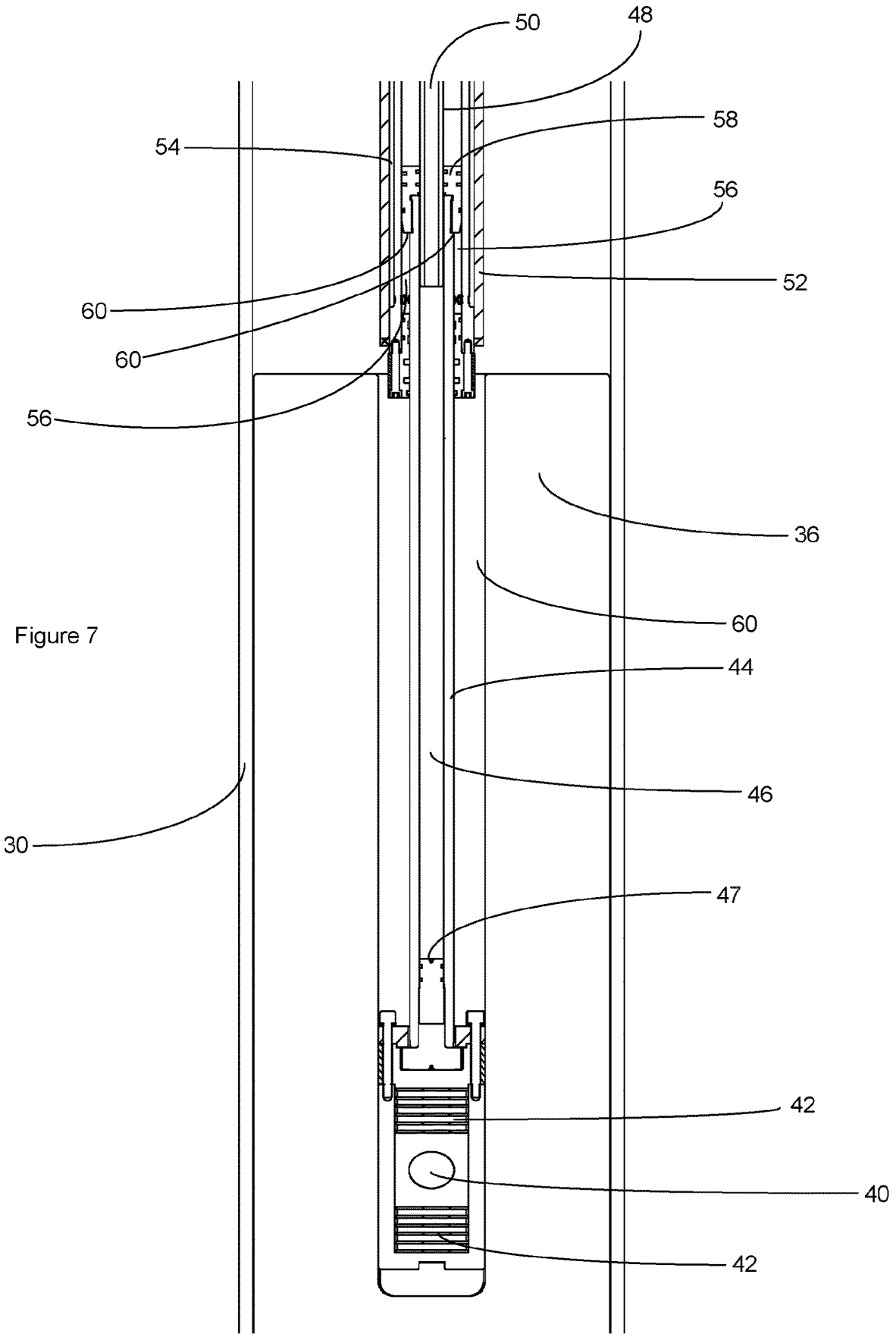
FIG. 7 is an enlargement of the portion marked VII of FIG. 6.

With particular reference to the enlarged section of FIG. 7, the hydraulic actuator has an inner hydraulic piston 44 which is supplied with hydraulic fluid under pressure during the downward phase of the hammer, via a hollow section 46 which receives a hollow piston rod 48. The fluid supply to the inner piston volume 46 arrives via the hollow section 50 of the piston rod from the valve block 26 at the top of the hammer. It will be noted that causing pressure to be applied in this area allows the piston 44 to slide along the rod 48 and extend in a telescoping fashion. This then causes the drop weight to move downwardly. It will be noted that the working surface area during this downward phase is that of the area of the rod 48 (including the hollow inner area 50; thus calculated as pi multiplied by the radius of the outside diameter of the rod 48 squared) in FIG. 7. This area is approximately the same as that of the piston surface marked 47, but will be slightly smaller because the outer diameter of the rod 48 will be dimensioned to allow a sliding clearance between the rod 48 and the hollow section 46.

The actuator also includes a casing 52 which forms an outer bore around the outside of the actuator and which includes a further hydraulic passage 54 which allows fluid, as described below, to drive the drop weight upwardly.

Fluid which passes through the passage 54 comes down the housing 52 from the valve block 26, is reversed near the end of the housing 52 and travel back up in inner passages 56 towards a second piston 58 which is mounted around the outside of the inner hydraulic piston 44. This outer piston 58 is driven upwardly by hydraulic fluid acting on surfaces 60 which face generally downwards. It will be noted that the working area of the surfaces 60 may be varied by reducing or increasing the diameter of the piston 58. Thus an optimal ratio between speed and force in upward and downward phases (typically 5:1), may be achieved as in the prior art arrangement.

In operation, hydraulic pressure is fed constantly to the voided volume 46 which causes a constant extension bias on the actuator. When it is desired to raise the drop weight 36, hydraulic pressure is applied through the passages 54 and 56 to apply force to the piston surfaces 60 on the outer piston 58. Because the area 60 of the outer piston is larger than the area of the inner hydraulic piston 44, a force imbalance arises and the actuator contracts with the rod 48 filling the void 46 and the drop weight being lifted being lifted. As this happens, the outer bore gradually enters a generally central space 60 formed in the drop weight 36 so that in the retracted, lifted position, the actuator is substantially housed within the drop weight 36, which helps reduce the overall length of the hammer.

By supplying the outer piston 58 with hydraulic fluid via passages 54 and 56 formed in or adjacent the outer bore 52, the packaging of the actuator is particularly compact.

At the top of the stroke, hydraulic pressure on the passages 54 and 56 is relieved by switching of the valve block 26, and these passages are opened to the low pressure tank side of the hydraulic system. Then the pressure in the volume 46 in addition to gravity acting on the drop weight 36, causes the piston 44 to extend and the drop weight to accelerate downwardly.

In this way, the drop weight is caused to reciprocate between its upper and lower positions by a simple switching of pressurized hydraulic fluid into the passages 54 and 56 followed by venting these passages to the low pressure tank side of the hydraulic power source. At the same time, complete design freedom of the relative upward and downward speeds of the drop weight is afforded by design of the ratios of the areas of the working surfaces 47 and 60 of the inner and outer pistons 44 and 58. Design freedom to adjust these areas is provided by the new structural arrangement of the hammer actuator. Furthermore, the actuator is able to be aligned centrally and axially with the drop weight meaning that side loading is practically eliminated and also that packaging is considerably enhanced. It will be noted in particular that for subsea applications, the entire electronics pack, valve pack and hydraulic actuator is completely contained within the upper and lower housings 28 and 30 which are relatively simple cylindrical components and therefore simple to manufacture and seal effectively.

The invention claimed is:

1. A double-acting hydraulic impact hammer for pile driving, the hammer comprising a drop weight and an inner hydraulic piston, the drop weight being mechanically coupled to the inner hydraulic piston and being arranged to be driven in use, in an upward and downward direction and the drop weight being arranged to act on a pile during the downward motion of the drop weight, the inner hydraulic piston having a voided internal area defining an inner piston volume which is arranged to receive a hollow piston rod and along which the inner hydraulic piston is free to extend and retract axially, the inner piston volume being in sealed hydraulic communication with the hollow rod volume to form a composite first hydraulic volume which changes size as the inner piston moves along the piston rod whereby the application of hydraulic pressure to the first volume biases the inner hydraulic piston towards a fully extended position, the hammer further including an outer bore surrounding the inner hydraulic piston and a collar fixed around the outside of the inner hydraulic piston which fits sealingly in the space defined between the outer bore and the outside of the inner hydraulic piston, the collar forming an outer piston having a working surface which is downward facing and which when exposed to hydraulic fluid at the same pressure as the first volume, has sufficient surface area relative to the working surface area of the inner hydraulic piston, to provide an upward force on the inner hydraulic piston sufficient to overcome the said extension biasing force and provide sufficient excess force to lift the inner hydraulic piston and the drop weight.

2. The hammer as claimed in claim 1, wherein the inner hydraulic piston and the piston rod are aligned generally with the center of mass of the drop weight so that in operation, lateral loads on the inner hydraulic piston are minimized.

3. The hammer as claimed in claim 1, wherein the drop weight is generally circular in cross-section and the inner hydraulic piston and the piston rod are generally aligned coaxially with the drop weight so that in operation, lateral loads on the inner hydraulic piston are minimized.

4. The hammer as claimed in claim 1, wherein the fluid supply for the outer piston passes through a passage in the outer bore.

5. The hammer as claimed in claim 1, wherein the outer bore is dimensioned to fit inside the drop weight when the inner hydraulic piston is in a retracted position.

6. A double-acting hydraulic impact hammer for pile driving, the hammer comprising a drop weight and an inner hydraulic piston, the drop weight being mechanically coupled to the inner hydraulic piston and being arranged to be driven in use, in an upward and downward direction and the drop weight being arranged to act on a pile during the downward motion of the drop weight, the inner hydraulic piston having a voided internal area defining an inner piston volume which is arranged to receive a hollow piston rod and along which the inner hydraulic piston is free to extend and retract axially, the inner piston volume being in sealed hydraulic communication with the hollow rod volume to form a composite first hydraulic volume which changes size as the inner hydraulic piston moves along the piston rod whereby the application of hydraulic pressure to the first volume biases the inner hydraulic piston towards a fully extended position, the hammer further including an outer bore-surrounding the inner piston, the outer bore being dimensioned to fit inside the drop weight when the inner hydraulic piston is in a retracted position, and a collar fixed around the outside of the inner piston which fits sealingly in the space defined between the outer bore and the outside of the inner hydraulic piston, the collar forming an outer piston having a working surface which is downward facing and which when exposed to hydraulic fluid at the same pressure as the first volume, has sufficient surface area relative to the working surface area of the inner hydraulic piston, to provide an upward force on the inner piston sufficient to overcome the said extension biasing force and provide sufficient excess force to lift the inner hydraulic piston and the drop weight, and wherein the fluid supply for the outer piston passes through a passage in the outer bore.

7. The hammer as claimed in claim 6, wherein the drop weight is generally circular in cross-section and the inner piston and the piston rod are generally aligned coaxially with the drop weight so that in operation, lateral loads on the inner hydraulic piston are minimized.

8. The hammer as claimed in claim 6, wherein the inner piston and the piston rod is aligned generally with the center of mass of the drop weight so that in operation, lateral loads on the inner hydraulic piston are minimized.

9. The hammer as claimed in claim 7, wherein the inner piston and the piston rod is aligned generally with the center of mass of the drop weight so that in operation, lateral loads on the inner hydraulic piston are minimized.

* * * * *